United States Patent [19]

Bankson

[11] 4,177,089

[45] Dec. 4, 1979

[54] MAGNETIC PARTICLES AND COMPACTS THEREOF

[75] Inventor: Billye Bankson, Harvard, Ill.

[73] Assignee: The Arnold Engineering Company, Marengo, Ill.

[21] Appl. No.: 899,135

[22] Filed: Apr. 24, 1978

Related U.S. Application Data

[63] Continuation of Ser. No. 680,770, Apr. 27, 1976, abandoned.

[51] Int. Cl.[2] ..... C04B 35/00

[52] U.S. Cl. ..... 148/31.55; 75/200; 75/230; 75/246; 75/255; 148/104; 148/105; 428/552

[58] Field of Search ..... 148/104, 105, 31.55; 252/62.55; 264/DIG. 58; 75/200, 201, 211, 255, 230, 246; 428/552, 428

[56] References Cited

U.S. PATENT DOCUMENTS

| | | | |
|---|---|---|---|
| 1,878,539 | 9/1932 | Reinhardt et al. | 75/200 |
| 2,158,132 | 6/1939 | Legg | 148/31.55 |
| 2,791,561 | 5/1957 | Beller et al. | 148/104 |
| 2,864,734 | 12/1958 | Adams et al. | 148/104 |
| 2,977,263 | 3/1961 | Harendza-Harinxma | 148/104 |
| 2,988,806 | 6/1961 | Adams et al. | 75/201 |
| 3,306,742 | 2/1967 | Adams et al. | 148/104 |
| 3,498,918 | 3/1970 | Copp | 148/104 |
| 3,607,462 | 9/1971 | Laing | 148/104 |
| 3,661,570 | 5/1972 | Moss | 148/104 |
| 3,902,930 | 9/1975 | Sata et al. | 148/31.55 |

*Primary Examiner*—L. Dewayne Rutledge
*Assistant Examiner*—John P. Sheehan
*Attorney, Agent, or Firm*—Vincent G. Gioia; William J. O'Rourke, Jr.

[57] ABSTRACT

Magnetic particles and compacts formed therefrom for use as magnetic cores formed of a blend of iron particles and particles of sendust, with the particles containing a coating of an electrical insulator thereon. The particles are compacted and annealed in the practice of this invention to form magnetic cores.

13 Claims, No Drawings

MAGNETIC PARTICLES AND COMPACTS THEREOF

This is a continuation of application Ser. No. 680,770, filed Apr. 27, 1976 and now abandoned.

This invention relates to magnetic particles for use in the preparation of compacted magnetic components, and more particularly to magnetic particles and compacted cores prepared therefrom characterized by moderately high permeability and low losses over a wide frequency range.

Magnetic cores for use in transformers and a number of other magnetic applications are presently prepared from magnetic particles which are electrically insulated and compacted under high pressures into the desired configuration. One such process for producing cores is described in U.S. Pat. No. 2,105,070. Variations on that process are described In U.S. Pat. Nos. 2,977,263, 3,014,825 and 3,666,571.

The primary objective in such methods to produce cores is to provide high magnetic permeability while maintaining core losses as low as possible. As is well known to those skilled in the art, core losses are the losses of energy in air inductor, including eddy current losses (which vary directly with the square of the frequency), hysteresis losses and residual losses.

The quality of inductors is normally expressed as the "Q" factor, as the ratio of reactance to resistance. It is expressed by the formula:

$$Q = \frac{2\pi fL}{R_{DC} + R_{AC}}$$

where f is the frequency in cycles per second, L is the inductance in henries, $R_{DC}$ is the resistance of the wire in ohms and $R_{AC}$ is the resistance in ohms due to losses in the core as described above (i.e., eddy current losses, hysteresis losses and residual losses).

It is known that good permeability with low losses can be achieved with iron powder, molybdenum Permalloy powder or sendust. Such powders are process in accordance with conventional techniques, including insulating the powders and thus compacting them to the desired configuration. One of the difficulties with the cores thus produced is their manufacturing cost as very high pressures of the order of 130 to 145 tons per square inch should be used to assure the desired mechanical strength. In addition, such cores are characterized by a somewhat modest Q and permeability.

It is an object of the present invention to provide magnetic particles and compacted cores prepared therefrom which overcome the foregoing disadvantages.

It is a more specific object of the present invention to provide magnetic particles and compacted cores produced therefrom wherein the cores are characterized by improved permeability, high Q values and low energy losses.

It is yet another object of the invention to provide magnetic particles for use in the preparation of compacted cores wherein the magnetic particles can be compacted using lower pressures than heretofore usable without sacrificing properties in the resulting compacted cores.

The concepts of the present invention reside in magnetic powders for compaction into cores wherein the powders are formed of a blend of iron particles and particles of sendust, with all of the particles containing an electrical insulating coating thereon. It has been found that such blends may be compacted to form compacted magnetic cores at lower pressures than heretofore available in the prior art to produce cores having significantly improved properties.

In the practice of this invention, particles of substantially pure iron are blended with particles of sendust, an alloy well known to those skilled in the art, composed of 7 to 13% by weight silicon, 4 to 7% by weight aluminum, with the balance being iron and its usual impurities in trace amounts. The use of iron powder over sendust alloys by themselves of the prior art not only improves the quality of the magnetic cores produced in the practice of this invention, but also enables the blend of magnetic particles to be compacted at lower overall pressures.

As the iron powder, use is preferably made of sponge iron, a commercially available material from Hoeganes Sponge Iron Co.

The relative proportions between the iron particles and the sendust particles can be varied within relatively wide limits. It has been found that higher proportions of iron require high currents but increase the flux of the core, whereas higher amounts of sendust require higher current and provide lower flux, while providing higher permeability. It has been found that best results are usually obtained when the blend of iron particles and sendust particles are blended in amounts such that the iron constitutes 70–30% of the blend and the sendust constitutes 30–70% of the blend. The sendust powder can be produced in any of a variety of ways from an ingot of an alloy. One simple procedure simply involves induction melting of an ingot of sendust followed by casting of the alloy to a configuration which can be easily ground to produce a powder. In that regard, the particle size of the sendust powder as well as the powder size of the iron particles is not critical and can be varied within relatively wide ranges. Best results are usually obtained when the iron and sendust particles have a particles size capable of passing through sieve mesh sizes ranging from −50 to 200. Generally, such particles have an average particle size ranging from 20 to 100 microns.

After the sendust powder is obtained, it is preferably annealed in a hydrogen-containing atmosphere to relieve strains induced by grinding. For that purpose, it is sometimes desirable to blend with the sendust particle a non-agglomerating material which is inert at the annealing temperature to prevent welding of the particle each to the other during the annealing step. Such practices are, of themselves, conventional. After the sendust powder has been obtained and annealed to relieve grinding strains, it and the iron particles can be blended together in accordance with conventional techniques, and the particles electrically insulated. Alternatively, the particles of iron and sendust can be electrically insulated prior to blending if desired.

Techniques for electrically insulating such powders are well known to those skilled in the art as described in U.S. Pat. No. 2,105,070, the disclosure of which is incorporated herein by reference. In the usual practice, the metal powders are contacted with a slurry composed of an alkali metal silicate, a clay and an alkaline earth metal oxide whereby the metal particles become coated with the slurry. One insulating composition which can be used is formed of about 67 grams of sodium silicate, 100 grams of milk of magnesia (MgO) and kaolin clay. The electrical insulation can be applied in a plurality of coats, with the first coat not including the clay additive. For this purpose, the slurry is contacted with the metal powders in a plurality of coating steps, each being followed by an intermediate drying step at a temperature sufficient to drive off the water and deposit the inorganic insulating metal on the metal surfaces. Temperatures for this purpose range from 80° to 350° F.

The amount of slurry applied to the particles is likewise not critical, and can be varied within wide ranges. It is generally sufficient that the inorganic electrical insulating material form a complete coating on the particles; amounts for that purpose generally range from about 0.1% to about 5% dry weight, based upon the weight of the metal powder.

After the iron particles and the sendust have been insulated, either separately or together, the powder blend is pressed into the desired configuration, most frequently a toroidal configuration, although other configurations can likewise be used. The powder is compacted by the use of high pressures in accordance with conventional techniques. One of the advantages, however, of the powders of the present invention is that they can be compacted to form a core having the desired mechanical strength at pressures lower than those typically applied in the prior art in the manufacture of cores from blends of iron and molybdenum Permalloy alloys. The latter generally required pressures ranging from 130 to 145 tons/sq.in., whereas pressures ranging from 60 to 140 tons/sq.in. can be applied quite satisfactorily in the practice of this invention. The preferred pressing pressure used in the practice of this invention ranges from 65 to 100 tons/sq.in., either with or without a dry or liquid lubricant.

After pressing, the cores are preferably annealed at an elevated temperature, preferably ranging from 1000° to 1500° F. for a time sufficient to form a cohesive compacted material. The annealing times ranging from 10 minutes to 2 hours are usually sufficient for this purpose. The high temperature annealing not only serves to relieve the stresses induced by pressing, but also serves to reduce oxygen losses. The annealing step is carried out in a hydrogen-containing atmosphere (non-reducing conditions).

After annealing, the cores can be subjected to conventional processing techniques. For example, the core can be impregnated with a conventional coating material and again re-annealed under like conditions, followed by painting. At that point, the core is completed and is ready for use.

Having described the basic concepts of the invention, reference is now made to the following examples, which is provided by way of illustration and not by way of limitation, of the practice of this invention to produce cores having significantly improved properties over the prior art.

EXAMPLE 1

This example is provided by way of a comparison, illustrating the practice of the prior art.

A series of cores are produced in accordance with conventional techniques. In the first, sponge iron alone is formed into a toroidal core having an outer diameter of about 3 inches and an inner diameter of about 1.9 inches, with a height of about 0.57 inches. Another core is produced by blending sponge iron of the type described above with a molybdenum-containing Permalloy alloy (MPP) of the sort described in U.S. Pat. No. 3,607,642 having the same dimensions. That core is then tested, both before and after annealing.

The results of those tests are set forth in the following table.

| | Sponge Iron | Sponge iron + MPP before annealing | Sponge iron + MPP after annealing |
|---|---|---|---|
| Inductance (microhenry) | 1384 | 1283 | 419 |
| $R_{bridge}$(ohms) | 2.3 | 2.7 | 13.4 |
| Losses (microhenry/cu.cm.) | 6.7 | 10.7 | 462.2 |
| Q | 42 | 28.1 | 1.0 |

EXAMPLE 2

Using the practice of this invention, equal quantities by weight of sponge iron (EP 1024) are blended with sendust, and the particles insulated by contact with a slurry composed of sodium silicate, kaolin, magnesium oxide and water.

Following insulation, the powder blend is then pressed at 80 tons/sq.in. into a toroidal configuration having approximately the same dimensions as described in Example 1. After pressing, the core is annealed in a belt furnace under a hydrogen atmosphere. The core is then impregnated with a protective material and re-annealed at 1200° F. under a hydrogen atmosphere for ½ hour.

The properties of the cores produced in the practice of this invention, both before and after annealing are set forth in the following table.

| | Sponge iron + sendust before annealing | Sponge iron + sendust after annealing |
|---|---|---|
| Inductance (microhenry) | 892 | 1461 |
| $R_{bridge}$(ohms) | 1.5 | 1.5 |
| Losses (microhenry/cu.cm.) | 3.6 | 1.3 |
| Q | 119.8 | 196.1 |

As can be seen from the foregoing data, the cores of the present invention have a markedly improved inductance and quality factor Q as compared to the prior art; they are also characterized by low levels of energy losses as compared to the prior art.

It will be understood that various changes and modifications can be made in the details and procedure formulation and use without departing from the spirit of the invention, especially as defined in the following claims.

I claim:

1. Magnetic powders for compaction into cores consisting essentially of a blend of (1) 30 to 70% by weight iron particles, and (2) 70 to 30% by weight particles of an iron alloy consisting essentially of 7 to 13% by weight silicon, 4 to 7% by weight aluminum and the balance being iron, said particles containing a coating of an electrical insulator thereon to electrically insulate each of the particles from the other.

2. Powders as defined in claim 1 wherein the iron particles are particles of sponge iron.

3. Powders as defined in claim 1 wherein the insulator is an inorganic insulator.

4. Powders as defined in claim 1 wherein the insulator is a blend of an alkali metal silicate and an alkaline eart h metal oxide.

5. Powders as defined in claim 1 wherein the insulator also contains a clay.

6. A magnetic core formed of a blend consisting essentially of (1) 30 to 70% by weight iron particles and (2) 70 to 30% by weight particles of an iron alloy consisting essentially of 7 to 13% by weight silicon, 4 to 7% by weight aluminum and the balance being iron, said particles containing a coating thereon of an electrical insulator and compacted together.

7. A core as defined in claim 6 wherein the iron particles are particles of sponge iron.

8. A core as defined in claim 6 wherein the insulator is an inorganic insulator.

9. A core as defined in claim 6 wherein the insulator is a blend of an alkali metal silicate and an alkaline earth metal oxide.

10. A core as defined in claim 9 wherein the insulator also contains a clay.

11. A magnetic core formed of a blend consisting essentially of (1) 30 to 70% by weight iron particles and (2) 70 to 30% by weight particles of an iron alloy consisting essentially of 7 to 13% by weight silicon, 4 to 7% by weight aluminum and the balance being iron, said particles containing a coating thereof of an electrical insulator and having been compacted together at a pressure within the range of 60 to 140 tons/sq.in. and annealed in a hydrogen-containing atmosphere at a temperature within the range of 1000° to 1500° F.

12. A core as defined in claim 11 wherein the insulator is a blend of an alkali metal silicate and an alkaline earth metal oxide.

13. A core as defined in claim 12 wherein the insulator also contains a clay.

* * * * *